United States Patent [19]

Williams, Jr.

[11] Patent Number: 5,009,588

[45] Date of Patent: Apr. 23, 1991

[54] TIME-DELAY CIRCUIT FOR AUTOMATIC SHUTDOWN OF FURNACE SYSTEMS

[75] Inventor: Roger W. Williams, Jr., Springfield, Mass.

[73] Assignee: R. E. Phelon Company, Inc., East Longmeadow, Mass.

[21] Appl. No.: 544,192

[22] Filed: Jun. 26, 1990

[51] Int. Cl.[5] ..... F23N 5/00

[52] U.S. Cl. ..... 431/31; 431/69; 431/71

[58] Field of Search ..... 431/31, 69, 71

[56] References Cited

U.S. PATENT DOCUMENTS 2,704,571 3/1955 REichelderfer ..... 431/31

4,856,984 8/1989 Williams ..... 431/69

*Primary Examiner*—Carroll B. Dority

*Attorney, Agent, or Firm*—Chapin, Neal & Dempsey

[57] ABSTRACT

Time-delay circuit for automatic shutdown of furnace systems has an induced draft blower motor and a first circuit for providing energy to the blower motor from an energy source. A second circuit for energizing the primary control system of the furnace, includes a thermostat and an electronic switching means. When the thermostat is "closed", the second circuit is completed to energize the electronic switching element which starts the blower. An airflow switch is provided to sense the start of the blower and to thereby energize a primary control which provides gas to a burner of the furnace. A timer set to a predetermined time interval has an output and two input terminal connections, one connected to the output of the thermostat and another to the output of the primary control system. When the thermostat is "closed" and the burner is operating, the timer is disabled. However, when the thermostat is "closed" and the burner is not operating such as occurs during "lockout" conditions, upon elapse of the predetermined time interval, the timer output interrupts power to the electronic switching means, thereby shutting "off" power to the primary control and to the blower motor.

5 Claims, 1 Drawing Sheet

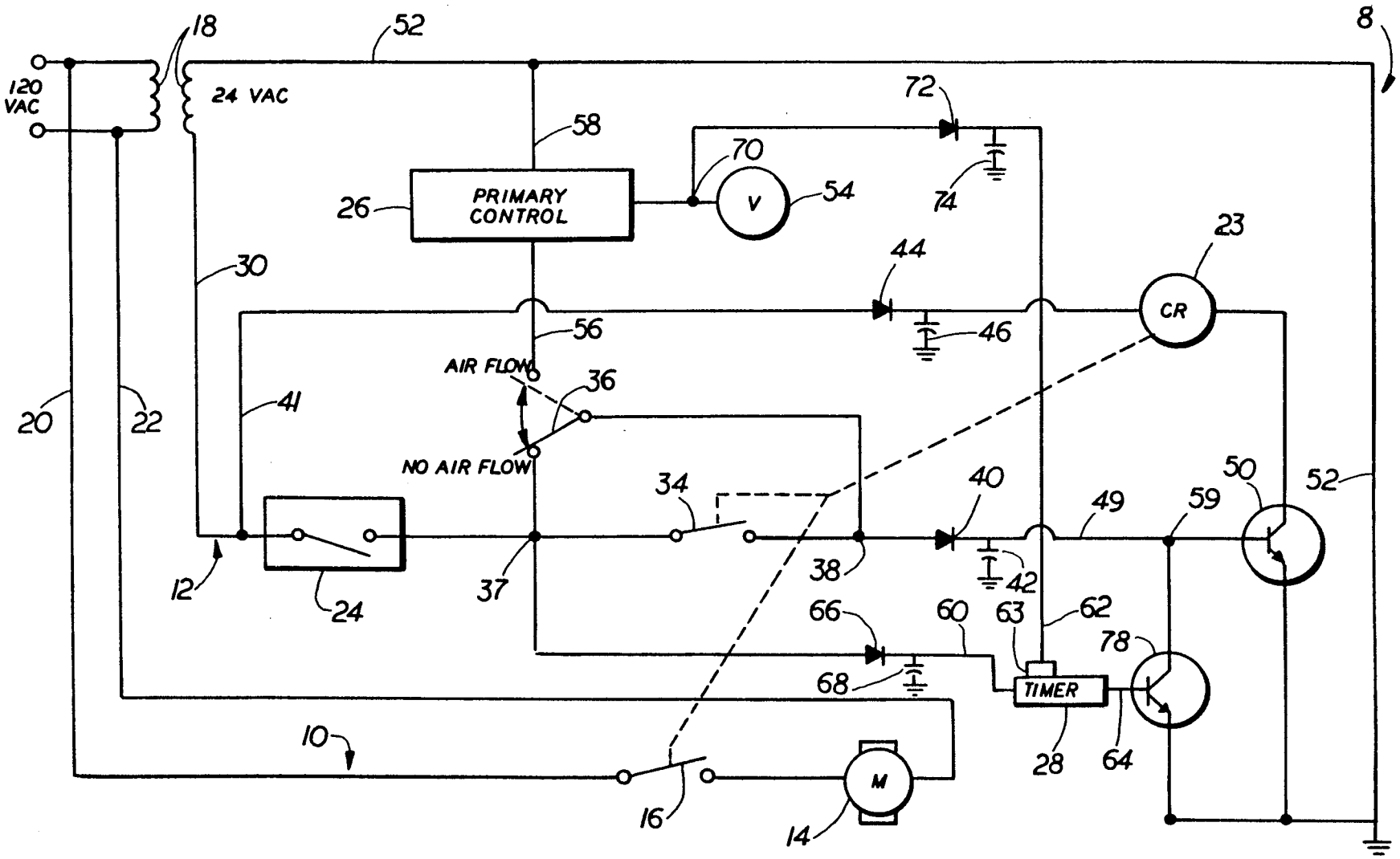
CR
TIMER
V
M
PRIMARY CONTROL
AIR FLOW
NO AIR FLOW
24 VAC
120 VAC

TIME-DELAY CIRCUIT FOR AUTOMATIC SHUTDOWN OF FURNACE SYSTEMS

BACKGROUND OF THE INVENTION

This invention relates to circuits for controlling the operation of a furnace and, more particularly, to circuits developed to prevent conditions which occur as a result of "lockout".

"Lockout" occurs where fuel, such as natural gas, fed to the burner fails to ignite or does ignite and then is subsequently extingished and the primary control system of the furnace shuts "off" the fuel supply thereto while the thermostat is still calling for heat. Since, in cooler weather, the temperature of the room will usually remain below the level set on the thermostat, the furnace will remain in this "lockout" condition until the primary control is reset, which is generally accomplished by interrupting power thereto by "opening" and then "closing" the thermostat.

In my U.S. Pat. No. 4,856,984, a control circuit is disclosed for automatically resetting the primary burner control after a "lockout" occurs but, in this system, no means is provided to monitor whether the primary control has turned "off" the fuel supply to the burner. The timer only monitors the thermostat operation and resets the furnace if the thermostat is "closed" and does not "open" again within a two-hour time interval. In addition, during such two-hour time period while the timer is running, the induced draft blower will continue to run and draw outside, cold air into the furnace and, as a consequence, accelerate cooling of the space being heated. Further, in some instances and for safety reasons, it is preferable to shutdown the furnace control when in the "lockout" condition and reset it manually.

Accordingly, the principal object of this invention is to provide a means for monitoring both the thermostat and the primary control system so as to shutdown the primary control after a short time interval when the furnace is in a "lockout" condition.

Another object of this invention is to provide means to shut "off" the induced draft blower motor when the fuel burner fails to ignite or the flame is extingished while the thermostat is still calling for heat.

The above and other objects and advantages of this invention will be more readily apparent from the following description read in conjunction with the accompanying drawing, in which:

The drawing shows an electrical schematic diagram of a time-delay circuit for automatic shutdown of a furnace system of the type embodying this invention.

The time-delay circuit for automatic shutdown of furnace systems, shown generally at 8, includes a power supply circuit 10 and a furnace control circuit 12. The power supply circuit 10 includes a motor 14, such as used to run the induced draft blower of the furnace, a relay switch 16 and a step down transformer 18. The blower motor 14 is connected by electrical leads 20 and 22 to a suitable electrical energy source, such as 120 volts alternating current. Relay switch 16, connected to lead 20, is normally biased "open" and is actuated by a relay control 23, as hereinafter will be more fully described. Step down transformer 18 is connected to provide energy, such as 24 volts AC, to the furnace control circuit 12.

As depicted in this embodiment, the furnace control circuit 12 includes a thermostat 24, a primary burner control 26, and a timer 28. The thermostat 24 may be of the conventional type and, at one side, is connected by conductor 30 to the 24 volt energy source. The other side of thermostat 24, identified as junction 37, is connected to an airflow switch 36, a normally "open" switch contact 34 in a parallel circuit to timer 28 and by conductor 60 to timer 28. The airflow switch 36 may be either a pressure or vacuum activated switch and is normally disposed in the lower position, as shown, which thereby provides an electrical path from junction 37 to junction 38. When the blower motor 14 is providing air to the furnace chamber, (not shown) the air switch 36 will be automatically shifted to its upper position. Diode 40 and capacitor 42 are also connected by lead 49 to junction 38 and to the base of a transistor 50 for providing a filtered DC voltage thereto.

Connected in parallel with thermostat 24, is a circuit path 41 which includes a diode 44, a capacitor 46, the relay control 23, and the collector electrode of transistor 50. When the thermostat 24 is "closed", energy is supplied via diode 40 to the base of transistor 50, thereby switching "on" the transistor 50 so that its collector-emitter current will flow through diode 44 to energize relay control 23. The relay control 23 provides means for "closing" relay switches or contacts 16 and 34. A current return path to the transformer 18 is provided by conductor 52.

Any suitable primary control system 26 may be utilized, such as Model No. S86H1006 by Minneapolis Honeywell employed in this embodiment. The primary control 26 provides an electrical voltage to operate fuel valve 54 and thereby controls the supply of fuel to the fuel burner (not shown). The primary control 26 is connected by conductor 56 to the airflow switch 36 and by switch 34, thermostat 24 and conductor 30 to one side of energy source 18 and by conductor 58 and lead 52 to the other side of the energy source 18.

The timer 28 may comprise a computer chip, such as Motorola Chip Model No. MC.14541 BCP, which, after a preselected period of time, such as two minutes, will generate an output signal. While two minutes may be preferable in this embodiment, it will be understood that within the scope of this invention, any suitable relatively short time interval may be selected. In any case, the timer 28 has at least two input terminals adapted to be connected to input leads or conductors 60 and 62 and output lead 64. Lead 60 connects thermostat 24 from junction 37 to timer 28 and includes a diode 66 and a capacitor 68 arranged to pass a filtered DC voltage which is utilized to power the timer 28. Lead 62 is connected, at one end, to junction 70 of the output lead of the primary control 26 and, at its other end, to reset pin 63 of the timer 28 and the circuit includes a diode 72 and a capacitor 74 connected therein. This circuit is provided so that when the primary control 26 generates an output of electrical energy to "open" fuel valve 54, some energy is also supplied to the timer reset pin 63 to cut "off" or disable the timer 28. From the timer 28, output lead 64 is connected to the base of a transistor 78, the collector of which is connected by junction 59 to lead 49 so that when the transistor 78 is turned "on", current to the base of transistor 50 will be shunted through the collector-emitter path of transistor 78 and thereby turn "off" transistor 50.

OPERATION

When thermostat 24 is "closed" and calling for heat, energy is conducted through junction 37 to the timer 28 by conductor 60 and by switch 36, in its lower position, to the base of transistor 50 via conductor 49. This causes transistor 50 to be turned "on", energizing relay control 23 which "closes" relay contacts 16 and 34. The blower motor 14 will be energized and begin to supply outside air to the furnace. This draft will cause airflow switch 36 to move to the upper postion which then provides a path for energizing the primary control system 26 of the furnace. The primary control 26 provides energy to "open" the fuel valve, supplying the burner with fuel. A portion of the energy is also connected to the reset pin 63 and thereby disables or stops the timing function of timer 28. Once the fuel at the burner ignites, the furnace will generally operate normally unless the flame is extinguished or, for some other reason, the primary control stops the output of energy to the fuel valve 54 while the thermostat 24 is still "closed", calling for heat. If this occurs, such as during a "lockout" condition, energy will no longer be supplied to the timer reset pin 63 of timer 28 and the timing function thereof will commence. When this occurs, blower 14 will continue to operate while the timer 28 is running and, should no energy be reapplied to the reset pin 63 until after the two minute interval set on the timer 28 has elasped, energy will be supplied by the output of timer 28 to the base of transistor 78 and thus turns "on" the transistor 78. As a result, energy will be shunted from the base of transistor 50 which will thus be turned "off", deenergizing relay control 23 so that contacts 16 and 34 will be "opened", thereby shutting down the blower 14 and cutting off power to the primary control 26. When the blower 14 stops, the airflow switch 36 will drop back to its lower position and the furnace control circuit 8 will remain in this state until reset by manually "opening" and then "closing" the thermostat 24.

This system is especially adaptable to gas-fired furnaces, but may be applied to oil burners as well. It is also noted that while the switch means illustrated comprise transistors 50 and 78, other suitable solid-state switching devices may be used without departing from the scope of this invention.

Having thus described my invention, what is claimed is:

1. In a time-delay circuit for automatic shutdown of furnace systems having a power source connected to an induced draft blower motor, a primary burner control adapted to energize a fuel valve of the furnace, a relay controller adapted to control the operation of the induced draft blower motor and the primary burner control, a thermostat connected to supply energy selectively to the primary burner control and to a first electronic switching means connected, when conductive, to energize said relay controller, a second electronic switching means is connected, when conductive to turn "off" the first electronic switching means, the improvement comprising a timer including connections for at least a first and a second input and one output, the first input of said timer being connected to receive energy from the thermostat, the second input being connected in circuit with the primary burner control and the fuel valve so that when the primary control energizes said fuel valve, the timer is also energized, the output of said timer being connected to said second electronic switching means so that when said timer generates an output signal, the second electronic switching means will be turned "on", said second electronic switching means being adapted to divert energy from and turn "off" said first electronic switching means to de-energize the relay controller and thus cut "off" both the primary burner control and the induced draft blower.

2. In a time-delay circuit for automatic shutdown of furnace systems, as set forth in claim 1, wherein said timing means comprises a computer chip.

3. In a time-delay circuit for automatic shutdown of furnace systems, as set forth in claim 1, wherein said first input includes an alternating current rectifying circuit comprising a diode and a capacitor.

4. In a time-delay circuit for automatic shutdown of furnace systems, as set forth in claim 1, wherein said second input also includes an alternating current rectifying circuit comprising a diode and a capacitor.

5. In a time-delay circuit for automatic shutdown of furnace systems, as set forth in claim 1, wherein said timer includes a reset pin which is connected to said second input lead.

* * * * *